US007950547B2

(12) United States Patent
Saunders et al.

(10) Patent No.: US 7,950,547 B2
(45) **Date of Patent: *May 31, 2011**

(54) RESERVOIR FOR LIQUID DISPENSING SYSTEM WITH ENHANCED MIXING

(75) Inventors: Robert C. Saunders, Medford, MA (US); Brett M. Belongia, North Andover, MA (US)

(73) Assignee: Millipore Corporation, Billerica, MA (US)

( * ) Notice: Subject to any disclaimer, the term of this patent is extended or adjusted under 35 U.S.C. 154(b) by 526 days.

This patent is subject to a terminal disclaimer.

(21) Appl. No.: 11/649,576

(22) Filed: Jan. 4, 2007

(65) Prior Publication Data

US 2007/0158360 A1 Jul. 12, 2007

Related U.S. Application Data

(60) Provisional application No. 60/758,296, filed on Jan. 12, 2006.

(51) Int. Cl.
*B67D 1/00* (2006.01)

(52) U.S. Cl. ..... 222/64; 222/424; 366/136

(58) Field of Classification Search ..... 222/63, 222/64, 107, 318, 424, 109, 215, 251; 366/137, 366/152.1, 153.1; 137/393, 337, 340, 454.4
See application file for complete search history.

(56) References Cited

U.S. PATENT DOCUMENTS

| | | | | |
|---|---|---|---|---|
| 1,947,851 A | | 2/1934 | Jewett | 259/95 |
| 2,764,722 A | | 9/1956 | McKeown et al. | 318/207 |
| 3,185,348 A | * | 5/1965 | Pollak et al. | 222/95 |
| 3,570,715 A | | 3/1971 | Evers | 222/54 |
| 3,642,047 A | * | 2/1972 | Waage | 383/109 |
| 3,790,029 A | | 2/1974 | Ward | 222/129.4 |
| 3,815,822 A | | 6/1974 | Davies et al. | 239/125 |
| 4,026,669 A | * | 5/1977 | Leonard et al. | 422/44 |
| 4,069,841 A | | 1/1978 | Barlett | 137/565.34 |
| 4,276,270 A | | 6/1981 | Gragg et al. | 423/167 |
| 4,322,298 A | * | 3/1982 | Persidsky | 210/787 |
| 4,396,383 A | * | 8/1983 | Hart | 604/518 |
| 4,493,705 A | * | 1/1985 | Gordon et al. | 604/122 |
| 4,608,178 A | * | 8/1986 | Johansson et al. | 210/744 |
| 4,621,928 A | | 11/1986 | Schreiber | |
| 4,718,462 A | * | 1/1988 | Fix | 141/9 |
| 4,734,269 A | * | 3/1988 | Clarke et al. | 96/156 |

(Continued)

FOREIGN PATENT DOCUMENTS

CA 2051438 10/1990

(Continued)

OTHER PUBLICATIONS

European communication dated Mar. 12, 2009.

(Continued)

*Primary Examiner* — Lien T Ngo
(74) *Attorney, Agent, or Firm* — Nields, Lemack & Frame, LLC

(57) ABSTRACT

Reservoir for a dispense system designed to maintain a suspending fluid flow within the reservoir. The fluid dispense system is particularly well suited to be manufactured in a single-use format comprising a fluid reservoir and fill tube assembly, particularly comprising a reservoir, tubing, fittings and connectors, and a needle. The system ensures uniformity within the liquid by moving the fluid through the product reservoir such as with a continuous or pulsating flow, and is designed to maintain the fluid in motion in order to maintain a homogenous solution. The reservoir is designed to minimize any fluid dead zones.

3 Claims, 4 Drawing Sheets

U.S. PATENT DOCUMENTS

| | | | | | |
|---|---|---|---|---|---|
| 4,793,515 | A | | 12/1988 | Shannon et al. | 222/69 |
| 4,857,355 | A | | 8/1989 | Gregg | |
| 4,863,454 | A | * | 9/1989 | LaBove | 604/416 |
| 4,976,707 | A | * | 12/1990 | Bodicky et al. | 604/408 |
| 5,004,571 | A | | 4/1991 | Litz et al. | 261/91 |
| 5,114,045 | A | * | 5/1992 | Herpe | 222/105 |
| 5,121,857 | A | | 6/1992 | Hutchinson | 222/318 |
| 5,137,175 | A | | 8/1992 | Kowalski et al. | 222/1 |
| 5,251,982 | A | * | 10/1993 | Stenstrom et al. | 383/209 |
| 5,445,193 | A | | 8/1995 | Koeninger et al. | |
| 5,480,063 | A | | 1/1996 | Keyes et al. | 222/64 |
| 5,490,809 | A | | 2/1996 | Jones et al. | |
| 5,493,765 | A | | 2/1996 | Klebl et al. | 29/407.08 |
| 5,538,462 | A | | 7/1996 | Gnadt | 451/114 |
| 5,570,815 | A | | 11/1996 | Ramsay | 222/95 |
| 5,680,960 | A | * | 10/1997 | Keyes et al. | 222/64 |
| 5,683,508 | A | | 11/1997 | Bleiler et al. | 118/46 |
| 5,697,407 | A | * | 12/1997 | Lasonde | 141/104 |
| 5,810,037 | A | * | 9/1998 | Sasaki et al. | 134/111 |
| 5,957,759 | A | | 9/1999 | Cardenas et al. | 451/60 |
| 6,027,240 | A | | 2/2000 | Han | 66/101 |
| 6,053,885 | A | * | 4/2000 | Beshel | 604/6.09 |
| 6,079,633 | A | | 6/2000 | Inoue et al. | 239/1 |
| 6,138,724 | A | | 10/2000 | Rivera et al. | |
| 6,183,460 | B1 | * | 2/2001 | Smith et al. | 604/408 |
| 6,186,193 | B1 | | 2/2001 | Phallen et al. | |
| 6,203,667 | B1 | | 3/2001 | Huhtelin | 162/253 |
| 6,491,679 | B1 | * | 12/2002 | Okamoto et al. | 604/410 |
| 6,726,771 | B2 | * | 4/2004 | Ueda | 118/633 |
| 6,779,685 | B2 | | 8/2004 | Nelson | 222/1 |
| 7,275,928 | B2 | | 10/2007 | Kolesar et al. | |
| 7,396,497 | B2 | | 7/2008 | Koetas et al. | |
| 7,810,674 | B2 | | 10/2010 | Belongia et al. | |
| 2002/0147440 | A1 | * | 10/2002 | Samolyk | 604/411 |
| 2003/0198125 | A1 | | 10/2003 | Linsen et al. | 366/152.1 |
| 2004/0164092 | A1 | | 8/2004 | DiLeo | 222/64 |
| 2005/0029301 | A1 | | 2/2005 | Belongia et al. | 222/189.09 |
| 2005/0146982 | A1 | | 7/2005 | Carlson et al. | 366/136 |
| 2005/0284882 | A1 | | 12/2005 | Belongia | 222/64 |
| 2007/0064519 | A1 | | 3/2007 | Neumann | 366/136 |

FOREIGN PATENT DOCUMENTS

| | | |
|---|---|---|
| CN | 1047813 | 12/1990 |
| DE | 670 057 | 1/1939 |
| DE | 1 472 745 | 2/1972 |
| DE | 1472745 | 2/1972 |
| EP | 0 440 310 | 10/1989 |
| EP | 1 750 103 | 2/2007 |
| FR | 2 411 318 | 7/1979 |
| GB | 652142 | 4/1951 |
| GB | 731815 | 6/1955 |
| GB | 891 334 | 3/1962 |
| JP | 2002-113342 | 4/2002 |
| NL | 7901305 | 8/1980 |
| WO | 82/03797 | 11/1982 |
| WO | 91/10615 | 7/1991 |
| WO | 01/28889 | 4/2001 |
| WO | 03/002590 | 1/2003 |
| WO | 2005/011852 | 2/2005 |

OTHER PUBLICATIONS

Chinese communication dated Mar. 20, 2009.
The European communication dated Mar. 17, 2009.
The European communication dated Mar. 18, 2009.
European communication dated Jun. 8, 2007.
Indian communication dated Jun. 24, 2008.
The European communication dated Aug. 24, 2007.
Internet citation Oct. 30, 2003, pp. 1-4, XP002382559 "Fortschrittliche Herstellungsprozesse fur halbfeste Produkte".
"Peristaltic Pump" pp. 1-2, XP002451276 ; Internet.
Office Action from co-pending U.S. Appl. No. 11/189,358 dated Jun. 15, 2009 & Dec. 4, 2008.
Chinese communication dated Jul. 3, 2009.
The European Communication dated Jul. 31, 2009.
OA dated Oct. 1, 2009 in co-pending U.S. Appl. No. 11/189,358.
The European communication dated Sep. 8, 2009.
Chinese communication dated Nov. 13, 2009.
Japanese communication dated Oct. 27, 2009.
Chinese communication dated Nov. 6, 2009.
Singapore communication dated Jan. 19, 2010.
European communication dated Feb. 5, 2010.
European communication dated Jul. 12, 2010 in co-pending foreign application (EP09151128.7).
European communication dated Jul. 12, 2010 in co-pending foreign application (EP06253702.2).
Notice of Allowance dated Jul. 6, 2010 in co-pending U.S. Appl. No. 11/189,358.
Indian communication dated Jul. 16, 2010 in co-pending foreign application (IN59/DEL/2007).
Japanese communication dated Jul. 27, 2010 in a co-pending foreign application (JP2007-003366 (MCA-724-JP)).
Office Action dated Nov. 29, 2010 in co-pending U.S. Appl. No. 12/283,797.

* cited by examiner

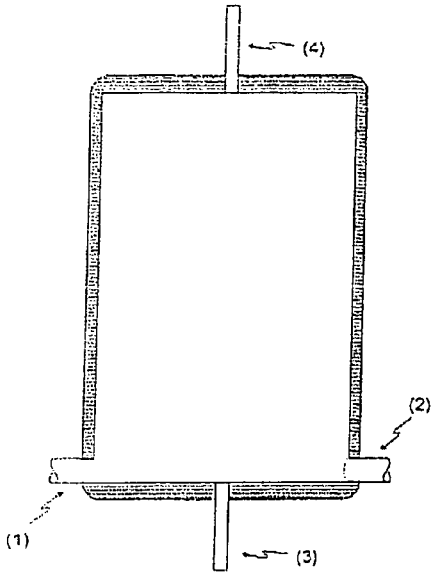
Figure 1. Reservoir design 1.
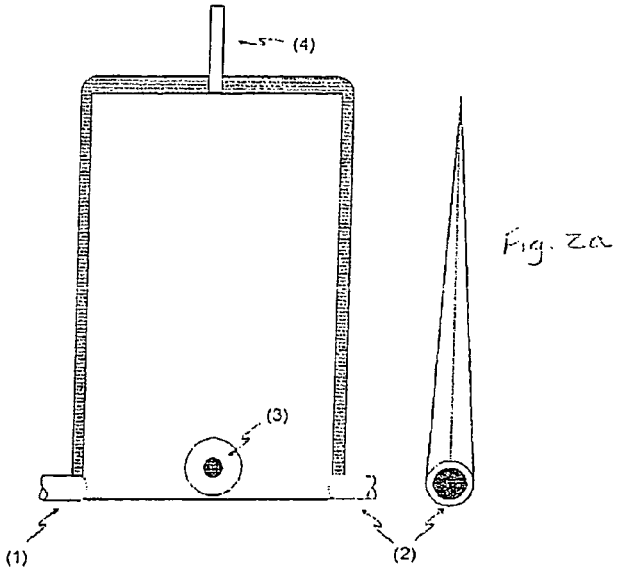
Figure 2. Reservoir design 2, showing side profile.
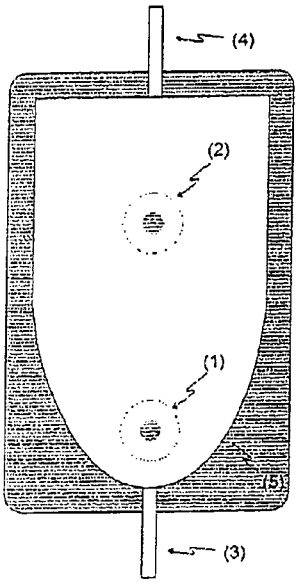
Figure 3. Reservoir design 3.
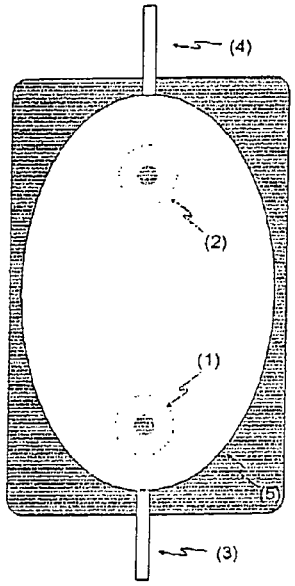
Figure 4. Reservoir design 4.

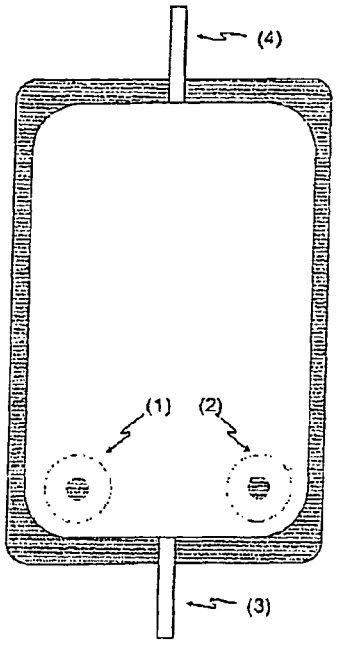
Figure 5a. Reservior design 5a.
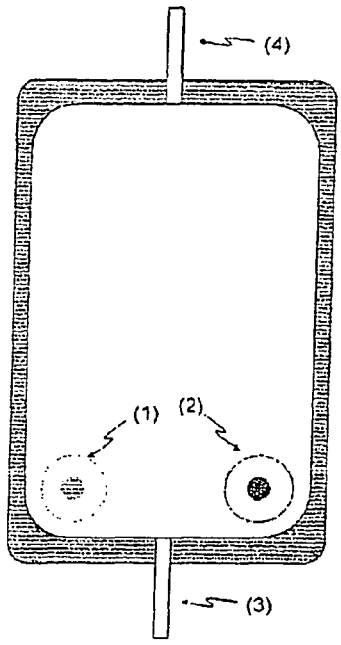
Figure 5b. Reservoir design 5b.
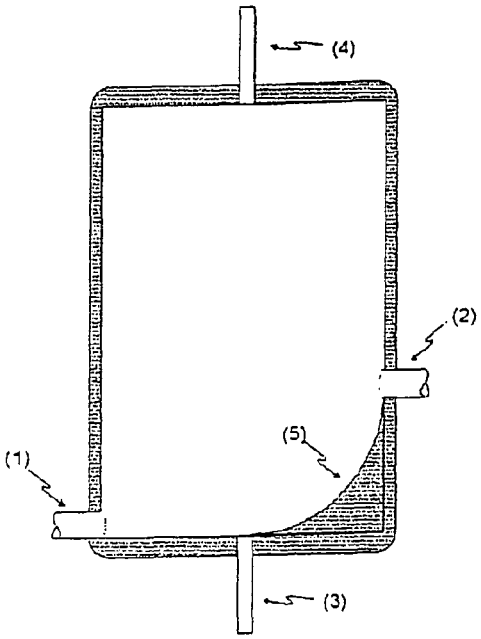
Figure 6. Reservoir design 6.
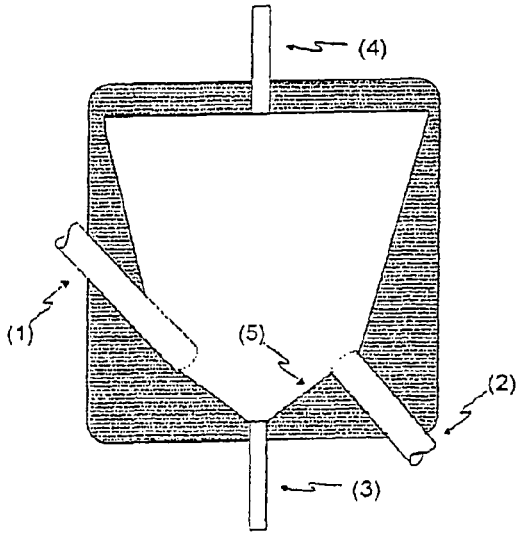
Figure 7. Reservoir design 7. Placement of (2) is arbitrary.

RESERVOIR FOR LIQUID DISPENSING SYSTEM WITH ENHANCED MIXING

This application claims priority of U.S. Provisional application Ser. No. 60/758,296 filed Jan. 12, 2006, the disclosure of which is incorporated herein by reference.

BACKGROUND OF THE INVENTION

There are various types of dispensing apparatuses for filling parenteral and ophthalmic products into vials and containers. One such type is positive displacement fillers. These devices employ a cylinder and piston arrangement, which contacts and dispenses the fluid. Typically, fluid enters the cylinder as the piston is in its upward motion, which creates a vacuum into which the fluid enters through an inlet port. The downward motion of the piston expels the fluid through an outlet port. The process can then be repeated. Other embodiments of positive displacement fillers also exist, such as those using rotary pumps.

While these fillers are popular due to their speed and accuracy, their application is limited, especially in the pharmaceutical field. These devices are very difficult to clean, and typically must be disassembled to be sterilized. Also, since the device actually contacts the fluid, contamination is a constant risk.

Another type of dispensing apparatus is the time/pressure filler. These typically include a fluid chamber that is held under constant pressure. Fluid is dispensed through a discharge line, which is controlled by a pinch type valve. The valve is opened for a precise amount of time to dispense fluid. Since the pressure is held constant, and the time interval is constant, the amount of fluid dispensed should also be constant. However, due to variances in the equipment and deformation of the discharge tube over time, these systems are less accurate than required for many applications.

A third type of dispensing apparatus is the volumetric dispensing apparatus, as shown in U.S. Pat. Nos. 5,680,960, 5,480,063, and Publication No. 2005-0029301, which are hereby incorporated by reference. These devices measure and dispense a predetermined volume of fluid. These systems are highly accurate and avoid problems of contamination common with positive displacement apparatus, since there are no moving parts in contact with the fluid.

The above mentioned apparatus can all be used to dispense single-phase fluids but all of the apparatus described suffer from one or more significant drawbacks when dispensing solids dispersed in liquid (suspensions) or droplets of one liquid suspended in another liquid (emulsions). Suspension products, such as vaccines or steroid products may settle when not properly agitated. In the case of emulsions, the two liquids will form droplets when they are agitated but when agitation stops, the droplets may separate into two separate layers. Either of these cases will result in poor content uniformity from one vial to the next during the final dispensing of the product.

In addition, it can be difficult to clean the process equipment that has contained suspensions or emulsions, resulting in labor intensive cleaning procedures and significant downtime to change from one batch to another. Since the final drug product must remain sterile, rigorous aseptic processes must be adhered to in the reassembly of the dispensing apparatus.

It is therefore an object of the present invention to provide a dispensing system and a reservoir therefore that has provision for the mixing of suspension and emulsion products, while maintaining the integrity of the system so that sterility is not negatively impacted. It is also an objective of this invention to minimize the amount of time spent cleaning the delivery system therefore minimizing the amount of downtime required.

SUMMARY OF THE INVENTION

The problems of the prior art have been overcome by the present invention, which provides a reservoir for a dispense system designed to maintain a suspending fluid flow within the reservoir. The system is particularly suitable for installation into a host apparatus for dispensing suspensions or emulsions. The fluid dispense system is particularly well suited to be manufactured in a single-use format comprising a fluid reservoir and fill tube assembly, particularly comprising a reservoir, tubing, fittings and connectors, and a needle. The system ensures uniformity within the liquid by moving the fluid through the product reservoir such as with a continuous or pulsating flow. The system is designed to maintain the fluid in motion in order to maintain a homogenous solution. The reservoir is designed to minimize any fluid dead zones.

BRIEF DESCRIPTION OF THE DRAWINGS

FIG. 1 is a schematic diagram showing one embodiment of a reservoir in accordance with the present invention;

FIG. 2 is a schematic diagram showing another embodiment of a reservoir in accordance with the present invention;

FIG. 2A is a side view of the reservoir of FIG. 2;

FIG. 3 is a schematic diagram showing yet another embodiment of a reservoir in accordance with the present invention;

FIG. 4 is a schematic diagram showing another embodiment of a reservoir in accordance with the present invention;

FIG. 5A is a schematic diagram showing yet another embodiment of a reservoir in accordance with the present invention;

FIG. 5B is a schematic diagram showing another embodiment of a reservoir in accordance with the present invention;

FIG. 6 is a schematic diagram showing yet another embodiment of a reservoir in accordance with the present invention;

FIG. 7 is a schematic diagram showing another embodiment of a reservoir in accordance with the present invention.

DETAILED DESCRIPTION OF THE INVENTION

The dispense system described here consists of a single-use dispense cartridge and a hardware component onto which the dispense cartridge can be installed. The hardware system is described in the prior art (U.S. Pat. Nos. 5,680,960 and 5,480,063, the disclosures incorporated herein by reference). The present invention provides for a novel reservoir that allows for a suspending fluid flow within the reservoir.

Preferably the fluid reservoir section of the dispense cartridge is a pliable or flexible chamber or bladder, which expands and contracts to maintain a constant internal pressure. Disposable bag-like enclosures are particularly suitable, constructed of flexible polymer-laminate film and sealed, such as thermally, at seams and port insertion points.

The tubing section of the dispense cartridge consists of flexible tubing such as silicone, polyethylene, or other elastomer or polymer based tubing attached together with plastic connectors made of materials such as polyethylene, polypropylene, or poly-fluorocarbons.

Figure 8:
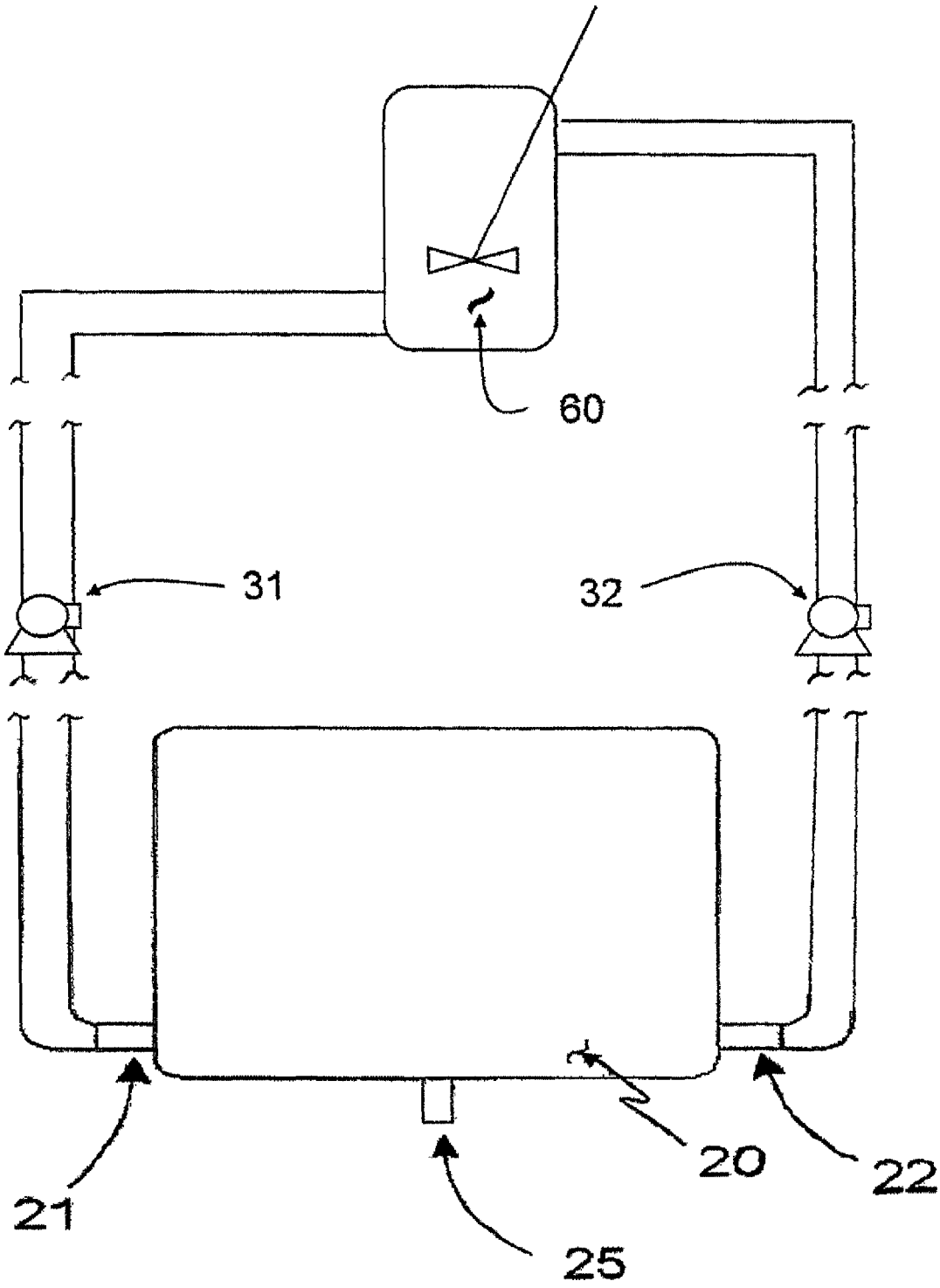
FIG. 8 is a schematic diagram showing an embodiment of a dispense cartridge.
Figure 9:
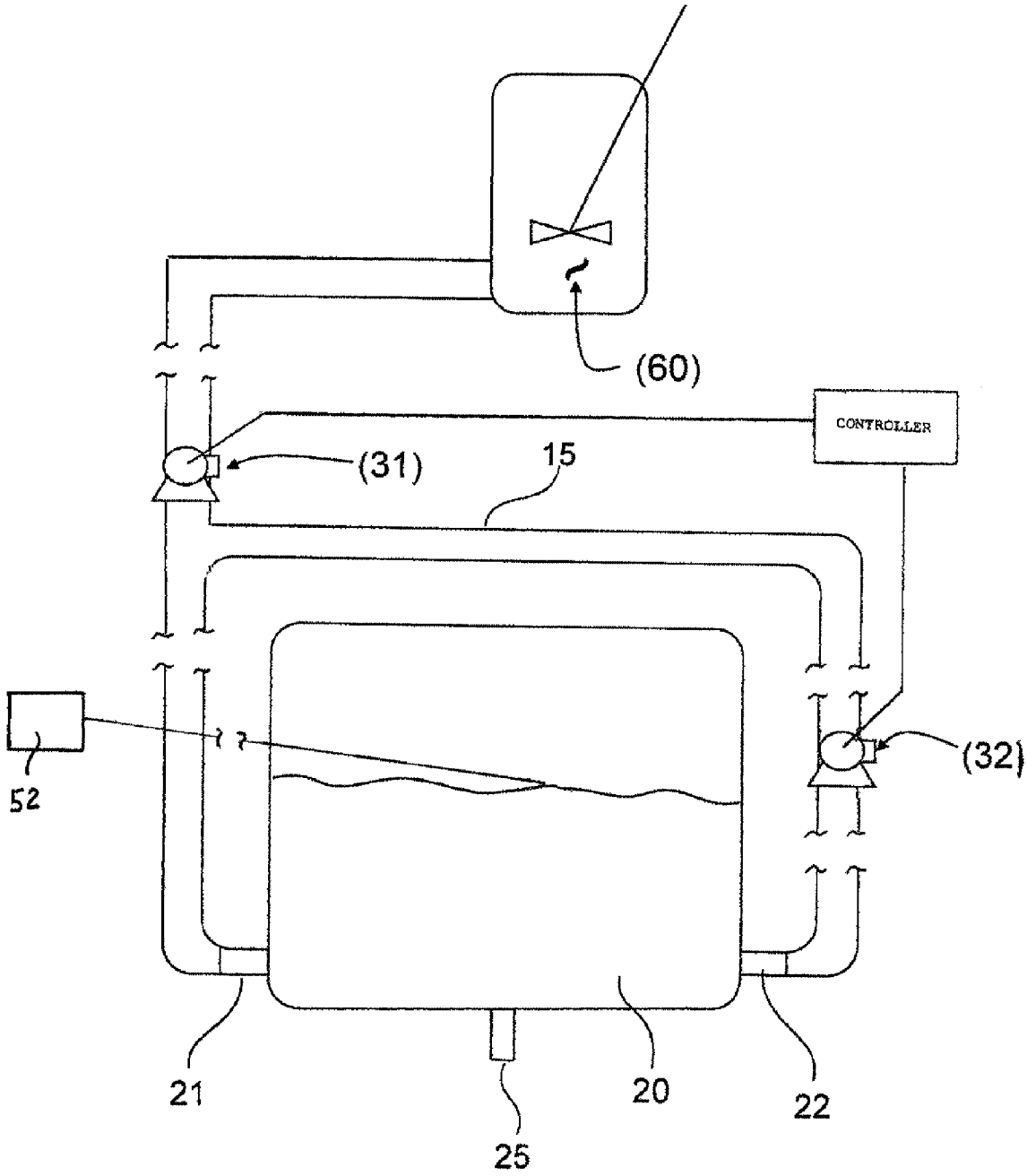
FIG. 9 is a schematic diagram showing another embodiment of a dispense cartridge.

Turning first to FIG. 8, an embodiment of a dispense cartridge which can contain the reservoir of the present invention is shown. A port (25) on the bottom of the reservoir (20) is provided to allow liquid to move to the tubing assembly used to deliver the product to its final containers (not shown). A single-loop dispensing system, including a feed pump (31) (such as a peristaltic pump) in fluid communication with a well mixed, bulk fluid supply source (60) and with the inlet or fill port (21) of the fluid reservoir of the dispense cartridge, and a draw pump (32) in fluid communication with an outlet (22) of reservoir of the dispense cartridge and the feed to the well mixed bulk fluid supply source (60), can be used. Alternatively, a circulation-loop scheme can be used to maintain flow through the dispense cartridge (FIG. 9). An inlet (21) and outlet (22) port on the reservoir (20) are connected with a tubing loop (15). A non-invasive pump (32), such as a peristaltic pump, circulates the product through a tubing loop in fluid communication with an inlet and outlet of the reservoir of the dispense cartridge. Thus, the intake of the pump (32) is in fluid communication with an outlet of the reservoir (22) of the dispense cartridge, and the outtake of pump is in fluid communication with an inlet of the reservoir (21) of the dispense cartridge. The pump is preferably on continuously during operation of the system to maintain the fluid in motion. This configuration requires that the pressure in the well mixed, bulk fluid supply source (60), at the transfer point, be greater than the pressure on the other side of the valve. This can be accomplished in any number of ways, such as by using gravity by elevating the bulk fluid supply source or by pressurizing the bulk fluid supply source or by introducing a Venturi restriction on the reservoir side of the valve in line with the reservoir re-circulation loop.

A level sensor (52) such as an optical sensor or capacitance sensor can be used to monitor the fluid level in the reservoir of the dispense cartridge, and the pump speeds may be controlled thereby to maintain a consistent fluid level. Alternatively, a level switch can be used, in which case the pumps may be controlled in an on/off fashion.

Alternatively still, an alternating or reversing pump can be used to maintain flow and mixing in the reservoir. A single peristaltic pump, capable of reversing direction, is in fluid communication with both the bulk fluid supply source and the reservoir of the dispense cartridge through suitable tubing. The fluid level in the reservoir of the dispense cartridge is monitored, such as with a level switch. When the fluid level in the reservoir reaches a predetermined level, the pump remains on but alternates direction so that product is alternately pumped into and out of the reservoir on a periodic or continuous basis. If the level in the reservoir of the dispense cartridge falls below the predetermined level, the pump is placed in a single direction mode to fill the reservoir to the desired level, and is then again placed in the alternating mode to alternately pump product into and out of the reservoir to maintain flow and prevent the solids from settling. In the event the withdrawal of fluid from the reservoir of the dispense cartridge does not mix the reservoir contents as efficiently as the filling of the reservoir, the speed of the pump may also alternate in accord with the pump direction so that the time that the pump is withdrawing fluid is less than 50% of the pump cycle time or the cycle time may be minimized.

Turning now to FIG. 1, there is shown an embodiment of the reservoir (20) section of the dispense cartridge. The reservoir 20 has a rectangular profile, with an arbitrary aspect ratio to be determined by the maximum rate of flow and the settling properties of the particular product to be dispensed. The reservoir is formed by thermally sealing polymer film. Feed port (1) and return port (2), through which recirculation of the contents occurs, are coaxial and opposite, and both ports adjoin the lower thermal seam of the reservoir such that there is no gap between the ports and the seam. A fill port (3) is provided by sealing it into the reservoir bag at a right angle, as is opposite headspace port (4). The fill port (3) connects to the bottom of the sight tube (not shown) of the dispensing system, and the headspace port (4) connects to the top of the sight tube.

FIGS. 2 and 2A illustrate another embodiment of the reservoir, where it is made of a single piece of plastic laminate film that is folded over at the bottom and sealed. The feed port (1) and return port (2) adjoin the lower fold such that the film is wrapped around the radius of the ports, which must be the same for both ports. The fill port (3) (FIG. 2, but not shown in FIG. 2A) is connected to the reservoir using a face-mounted port connection in order to avoid deforming the seam. Headspace port (4) is again positioned opposite fill port (3) at a right angle as in the FIG. 1 embodiment.

FIG. 3 illustrates a reservoir embodiment that does not have a rectangular profile, but rather is parabolic. In this embodiment, the feed port (1) is positioned at the focus of a conic section profile (5), created by thermal sealing of the lower portion of the bag. Both the feed port (1) and the return port (2) can be mounted to the reservoir using face-port connections. The fill port (3) and the headspace port (4) are connected as in FIG. 1.

FIG. 4 illustrates a similar design, except that the conic section (5) is shaped as an ellipse, with the feed port (1) and the return port (2) located at the opposite foci of the ellipse. The fill port (3) and the headspace port (4) are connected as in FIG. 1.

FIG. 5A illustrates a reservoir with a rectangular profile, except that the edges are rounded. In this embodiment, the feed port (1) and return port (2) are mounted on the same side of the reservoir such as by using face ports in the lower corners of the reservoir. Preferably the ports (1) and (2) are horizontally aligned, and are placed at the center of curvature of the bag seal corners. The fill port (3) and the headspace port (4) are connected as in FIG. 1. FIG. 5B illustrates a similar embodiment, except that the ports (1) and (2) are mounted on opposite sides of the reservoir (but again at the same horizontal locations).

As illustrated in FIG. 6, the configuration of the reservoir need not be symmetric. The bag seal profile (5) of FIG. 6 is an asymmetric design, and fills the reservoir corner opposite from the feed port (1). The profile (5) is designed to eliminate regions of slow flow in the distal portions of the reservoir, such as by directing the fluid jet produced by the feed port (1). The location of the return port (2) in this embodiment is not particularly limited, although it is preferably located in side of the reservoir opposite from the feed port (1) side. The fill port (3) and the headspace port (4) are connected as in FIG. 1.

FIG. 7 illustrates yet another asymmetric design. In this embodiment, the feed port (1) and the return port (2) are placed at angles other than 90° to the edge of the reservoir bag. The actual angle used should be one that improves the efficiency of mixing along the lower seam of the reservoir, such as 45° from the vertical axis of the bag for both the feed and return ports (which are, in turn, 180° from each other), particularly for a non-rectilinear reservoir such as the one shown. The position and angle of the return port (2) must be below the liquid level in the bag in order to ensure proper operation.

The existence and placement of the feed and return ports on every bag design permits the suspension to be mixed without a shaft penetration/seal on the bag. On certain bag designs, such as those shown in FIGS. 3, 4, 6 and 7, the geometry of the perimeter seal of the bag has been designed to create a fluid flow profile that improves the specific ability of the system to maintain the suspension of settling materials.

What is claimed is:

1. A fluid dispensing apparatus for dispensing a predetermined volume of a suspension or emulsion, comprising a reservoir comprising a sealed film defining flexible enclosure having a feed port and a return port spaced from said feed port and coaxially aligned therewith, a first pump in fluid communication with a fluid source and said reservoir for pumping said suspension or emulsion into said reservoir, and a second pump in fluid communication with said reservoir and said fluid source for pumping said suspension or emulsion from said reservoir.

2. The fluid dispensing system of claim 1, wherein said first and second pumps are peristaltic pumps.

3. The fluid dispensing system of claim 1, further comprising a fluid level determining device for determining the level of fluid in said reservoir, and a controller responsive to said fluid level determining device for controlling the speed of said first and second pumps based upon the fluid level in said reservoir.

* * * * *